US006071399A

United States Patent [19]

Van der Bergen et al.

[11] Patent Number: 6,071,399

[45] Date of Patent: Jun. 6, 2000

[54] ELECTROLYTIC CELL

[75] Inventors: Patrick Van der Bergen, Hove; Paul Jansen, Retie; William Fobelets, Lennik, all of Belgium

[73] Assignee: Agfa-Gevaert, Mortsel, Belgium

[21] Appl. No.: 09/228,166

[22] Filed: Jan. 11, 1999

[30] Foreign Application Priority Data

Jan. 15, 1998 [EP] European Pat. Off. ..... 98200079

[51] Int. Cl.[7] ..... C25B 15/02

[52] U.S. Cl. ..... 205/337; 205/571; 205/702; 205/771; 204/272; 204/228.1; 204/228.8; 204/228.9; 204/229.1; 204/229.8; 204/229.9; 204/230.1; 204/230.2; 204/230.7

[58] Field of Search ..... 204/272, 224 R, 204/237, 228.1, 228.2, 228.6, 228.7, 228.8, 229.1, 229.7, 229.8, 229.9, 230.1, 230.2, 230.7, 230.8, 228.9; 205/571, 702, 771, 337

[56] References Cited

U.S. PATENT DOCUMENTS

| | | | |
|---|---|---|---|
| 4,263,108 | 4/1981 | Berg et al. | 204/109 |
| 5,378,430 | 1/1995 | Van de Wynckel et al. | 204/272 |
| 5,401,374 | 3/1995 | Leutwyler | 204/272 |
| 5,454,924 | 10/1995 | Jansen et al. | 204/272 |
| 5,628,887 | 5/1997 | Patterson et al. | 204/272 |
| 5,753,099 | 5/1998 | Gravel et al. | 204/272 |
| 5,759,377 | 6/1998 | Damen et al. | 204/230.1 |
| 5,770,034 | 6/1998 | Jansen et al. | 204/230.1 |
| 5,951,844 | 9/1999 | Jansen et al. | 204/228.1 |

FOREIGN PATENT DOCUMENTS 3922959 7/1989 Germany .

*Primary Examiner*—Bruce F. Bell
*Attorney, Agent, or Firm*—Baker Botts L.L.P.

[57] ABSTRACT

An electrolytic cell comprises a housing (12), means (21) defining a liquid level (25) in said housing (12), a first contact surface (32) positioned above said liquid level (25) for making contact with a removable electrode (20) when positioned in said housing (12). A second contact surface (36) is positioned above said liquid level (25) and electrically isolated from said first contact surface (32) for making contact with said removable electrode (20) when positioned in said housing (12). A method of electrolysis in such a cell comprises supplying electrical power to said electrode (20) at an electrolysing potential ($U_P$) and controlling the electrolysing potential ($U_P$) in response to the potential ($U_2$) sensed at the second contact surface (36). Control of the electrolysis process is possible without influence of any unknown and variable resistance between the first contact surface and the electrode.

9 Claims, 4 Drawing Sheets

ELECTROLYTIC CELL

FIELD OF THE INVENTION

The present invention relates to an electrolytic cell and a method of electrolysis in such an electrolytic cell, in particular involving the removal of silver from silver containing solutions, such as fixing and bleach-fixing solutions.

BACKGROUND OF INVENTION

Electrolytic cells are known for the extraction of valuable materials by deposit upon a removable electrode, in particular the deposit of metals upon a removable cathode. Electrolytic silver recovery from used photographic solutions is a common way to extend the life of such solutions. In an apparatus for the electrolytic removal of silver, for example from used photographic fixer, the cell includes a housing, having a contact surface for making contact with a removable cathode when positioned in the housing, to supply electrolysing electrical power thereto. The contact surface is positioned above the liquid level in the cell. The cell is used by supplying electrical power to the cathode at an electrolysing potential via the contact surface. In use, silver from the silver containing solution is deposited on the face of the cathode which is directed towards the anode. After the cell is operated for some time, the cathode is removed from the cell and replaced. U.S. Pat. No. 5,378,340 (Michiels et al. assigned to Agfa-Gevaert NV) issued Jan. 3, 1995 describes an example of such an apparatus.

For optimum efficiency, the electrolysis process is controlled, in particular by seeking to control the potential on the cathode. This is achieved by controlling the potential applied to the contact surface.

However, in practice, the electrical contact between the contact surface and the cathode is not perfect. There tends to be a resistance between the contact surface and the cathode, which resistance is unknown and may well vary as electrolysis continues.

The high current which passes through the cell during electrolysis results in a significant potential drop across the junction between the contact surface and the cathode. As a result, the potential on the cathode is not necessarily the same as that applied to the contact surface. While the control regime applied to a given cell can be modified to account for this effect, such modification would not account for changes which might occur during electrolysis.

OBJECTS OF INVENTION

It is an object of the present invention to enable an electrolytic cell to be controlled in a more reliable manner.

SUMMARY OF THE INVENTION

We have discovered that this objective and other useful benefits may be achieved, by the provision of a second contact surface positioned above the liquid level and electrically isolated from the first contact surface for making contact with the removable electrode when positioned in the housing, by sensing the potential at a second contact surface and controlling the electrolysing potential in response thereto.

Thus, according to the invention, there is provided an electrolytic cell comprising a housing, means defining a liquid level in the housing, and a first contact surface positioned above the liquid level for making contact with a removable electrode when positioned in the housing, to supply electrolysing electrical power thereto, characterised by a second contact surface positioned above the liquid level and electrically isolated from the first contact surface for making contact with the removable electrode when positioned in the housing, to monitor the electrical potential on the electrode during use.

Usually, electrolytic processes result in the deposit of material upon a cathode. In these cases it is the cathode which constitutes the removable electrode of the present invention. The invention is however equally applicable to electrolytic cells intended for processes in which a material is deposited on an anode.

In these cases it will be the anode which is removable. In the following general description, references to cathodes and anodes may be interchanged, except where the context requires otherwise. The invention is particularly applicable to processes for the recovery of silver from silver-containing solutions, especially used photographic processing solutions. The invention is also applicable to electroplating processes. In the following general description, it is to be understood that references to silver recovery can be taken to also apply to other electrolytic processes, except where the context requires otherwise.

A liquid outlet from the cell may be the means by which a liquid level in the cell is defined. In one embodiment, the cell comprises a housing including a base, an anode positioned within the housing, a cathode surrounding the anode in the housing, an inlet opening, and an outlet opening through the base.

Preferably, the first contact surface is constituted by a first electrically conductive portion of an elongate member, the second contact surface being constituted by a second electrically conductive portion of the elongate member. The elongate member may be in the form of a ring, for example a ring positioned in a neck portion of the housing. Preferably, the second contact surface is formed of the same electrically conductive material as the first contact surface. Stainless steel is a suitable material.

In a preferred embodiment, the anode comprises a tube extending from the base. The anode tube may surround and be concentric with the outlet passage. The hollow interior of the anode tube may constitute a circulation passage, of annular cross-section, which surrounds the outlet passage.

A pump, such as a volumetric pump, may be connected to the outlet opening of the cell enabling the cell to be filled, de-aerated and operated under negative pressure. Where the cell is hermetically sealed, operation of the volumetric pump can be used to fill the cell with liquid through the inlet opening, by creating a negative pressure in the cell. The use of this arrangement enables the cell to work under negative pressure and also ensures that the liquid in the cell is de-aerated. This leads to more uniform deposition of silver at the cathode.

The outlet passage may open from the interior of the cell at a level above the level at which the circulation passage opens into the cell, thereby to define the liquid level in the cell. The inlet opening preferably opens into the cell between the anode and the cathode.

The cathode is removable from the cell. In order to enable the cathode to be removed, a removable lid may be provided which, when secured to the housing, serves to hermetically seal the cell. Alternatively, the lid may be integral with the cathode. The cell may further comprise clamping means for clamping the removable cathode against the first and second contact surfaces. Conveniently, the clamping means may be constituted by the removable lid of the cell.

Preferably, the lower edge of the cathode is positioned above the base of the housing to leave a space therebetween defining a sump. A further pump may be provided to circulate liquid through the cell. This circulation pump may be connected between the circulation passage and the interior of the housing to circulate liquid being treated through the cell. It is particularly beneficial if this circulation pump injects recirculating liquid tangentially into the sump of the housing, since this arrangement results in efficient mixing of the liquid.

The housing is preferably formed of electrically non-conductive material, and comprises a base wall and side walls, the anode being supported by the base wall and the cathode being positioned adjacent the side walls. The housing may be of any suitable shape, but it is preferred to be generally cylindrical, the anode being in the form of a tube positioned axially within the housing. In any case, the anode is preferably encircled by the cathode.

The cathode is preferably in sheet form and ideally has a frusto-conical cross-section, with its larger radius end uppermost, that is towards the circular upper opening of the cell. This configuration enables easy removal of the cathode even after a silver deposit has built up there-on after use. Usable cathode materials include stainless steel, silver and silver alloys, and other conductive materials, the non-silver containing materials being preferred from the point of view of costs, while the silver containing materials cause fewer starting-up problems. A cylindrical shape to the housing enables the cathode to be positioned near to the wall of the cell. By arranging for the lower edge of the cathode to be spaced from the base of the housing, it is possible for the reference electrode to be located in a side arm of the housing, the side arm opening into the housing below the level of the cathode.

The material used for the anode is less critical, although platinated titanium is usually used, but iridium might be used as well.

The cell may be associated with a control circuit including a power source for applying electrical power at an electrolysing potential to the first contact surface, means connected to the second contact surface for sensing the potential at the second contact surface and for controlling the electrolysing potential in response to the potential sensed at the second contact. The circuit from the power source to the second contact preferably has a resistance higher than that of the circuit from the power source to the first contact surface. The resistance is ideally such that the current flowing from the power source to the second contact is at least one order of magnitude lower than the current flowing from the power source to the first contact surface.

The invention also provides a method of electrolysis in an electrolytic cell comprising a housing and a removable electrode positioned in the housing, the method comprising supplying liquid to be treated to the cell and supplying electrical power to the electrode at an electrolysing potential via a first contact surface in contact with the electrode and positioned above the level of the liquid, characterised by sensing the potential at a second contact surface positioned above the level of the liquid, the second contact surface being electrically isolated from the first contact surface and in contact with the removable electrode, and controlling the electrolysing potential in response thereto.

The control of the electrochemical process taking place at the anode and the cathode is important in the silver recovery process. If too high a potential difference is applied, side reactions can occur, depending upon the nature of the silver-containing solution, leading to unwanted by-products. There are a number of known methods of controlling the desilvering process, including for example the methods referred to in the art as (i) galvanostatic, (ii) constant potential difference and (iii) potentiostatic.

In galvanostatic control, a constant current flows through the cell while it is in operation. As the desilvering progresses, the level of silver in the solution falls and the ohmic resistance between the anode and the cathode increases. It is therefore necessary to increase this potential difference in order to maintain a constant current. In a constant potential difference control method, the potential difference between the anode and the cathode is kept constant as the desilvering progresses. In potentiostatic control, a reference electrode is included in the electrolytic cell and the potential difference between the cathode and the reference electrode is kept constant. This method of operation is therefore widely preferred, since it is the cathode potential which determines electrochemical reactions which take place in a fixer of a given composition.

For optimum performance of the cell, it is important that the potential between the cathode and the reference electrode is accurately controlled. Usually the electrolytic cell further comprises a reference electrode for this purpose. The reference electrode may be positioned in a side arm of the housing, projecting into the sump. Where, for example, an Ag/AgCl reference electrode is used, the potential between the cathode and the reference electrode is about 400 mV. When the unit is to perform optimally, meaning employing the maximum current without causing side reactions to occur, the potential should be measured with an accuracy of some millivolts. The reference electrode may be a calomel type electrode or an Ag/AgCl type electrode. A suitable electrode has been disclosed in application EP 0 598 144 (Agfa Gevaert NV) filed Nov. 11, 1992 entitled "pH Sensitive Reference Electrode in Electrolytic Desilvering".

The silver-containing solutions which can be desilvered using the apparatus according to the present invention include any solution containing silver complexing agents, e.g. thiosulphate or thiocyanate, sulphite ions as an anti-oxidant and free and complexed silver as a result of the fixing process. The apparatus can also be used with concentrated or diluted used fixing solutions, or solutions containing carried-over developer or rinsing water. Apart from the essential ingredients, such solutions will often also contain wetting agents, buffering agents, sequestering agents and pH adjusting agents. The apparatus of the present invention can also be used for desilvering bleach-fixing solutions which may additionally contain bleaching agents such as complexes of iron(III) and polyaminocarboxylic acids. The desilvering process can be carried out batch-wise or continuously, the apparatus being connected, for example, to the fixing solution forming part of a continuous processing sequence.

The cell is preferably filled, de-aerated and operated under negative pressure. Thus, the method preferably includes filling the cell with liquid to be treated therein, through the inlet opening which opens into the cell between the anode and the cathode, by the application of negative pressure to an outlet passage which extends through the anode, and de-aerating the cell by circulating the liquid within the cell to generate a vortex above the outlet passage while continuing the application of negative pressure to the outlet passage. It is desirable to stop the circulation pump when too much air passes through the outlet opening. To achieve this, an optical sensor, capable of distinguishing between fluid and air in the outlet opening, may be positioned between the cell and the volumetric pump, but above the latter. In this way de-aeration of the cell can be achieved very quickly. Due to the action of the centrifugal pump a vortex is formed above the outlet opening. The air in the vortex is sucked in by the volumetric pump. When too much air is sensed in the outlet opening, the circulation pump is caused to stop, while the volumetric pump continues to operate. When the circulation pump stops, the vortex remains for about one second, allowing even more air to leave the cell. Once the optical sensor detects fluid, the centrifugal pump starts again, but with less air in the cell. After a few such de-aeration cycles, only a small air bubble is left. This bubble is too small to create a vortex and does not therefore enter the pumps.

BRIEF DESCRIPTION OF THE DRAWINGS

The invention will be described by the following illustrative embodiments with reference to the accompanying drawings without the intention to limit the invention thereto, and in which.

DETAILED DESCRIPTION OF THE INVENTION

Figure 1:
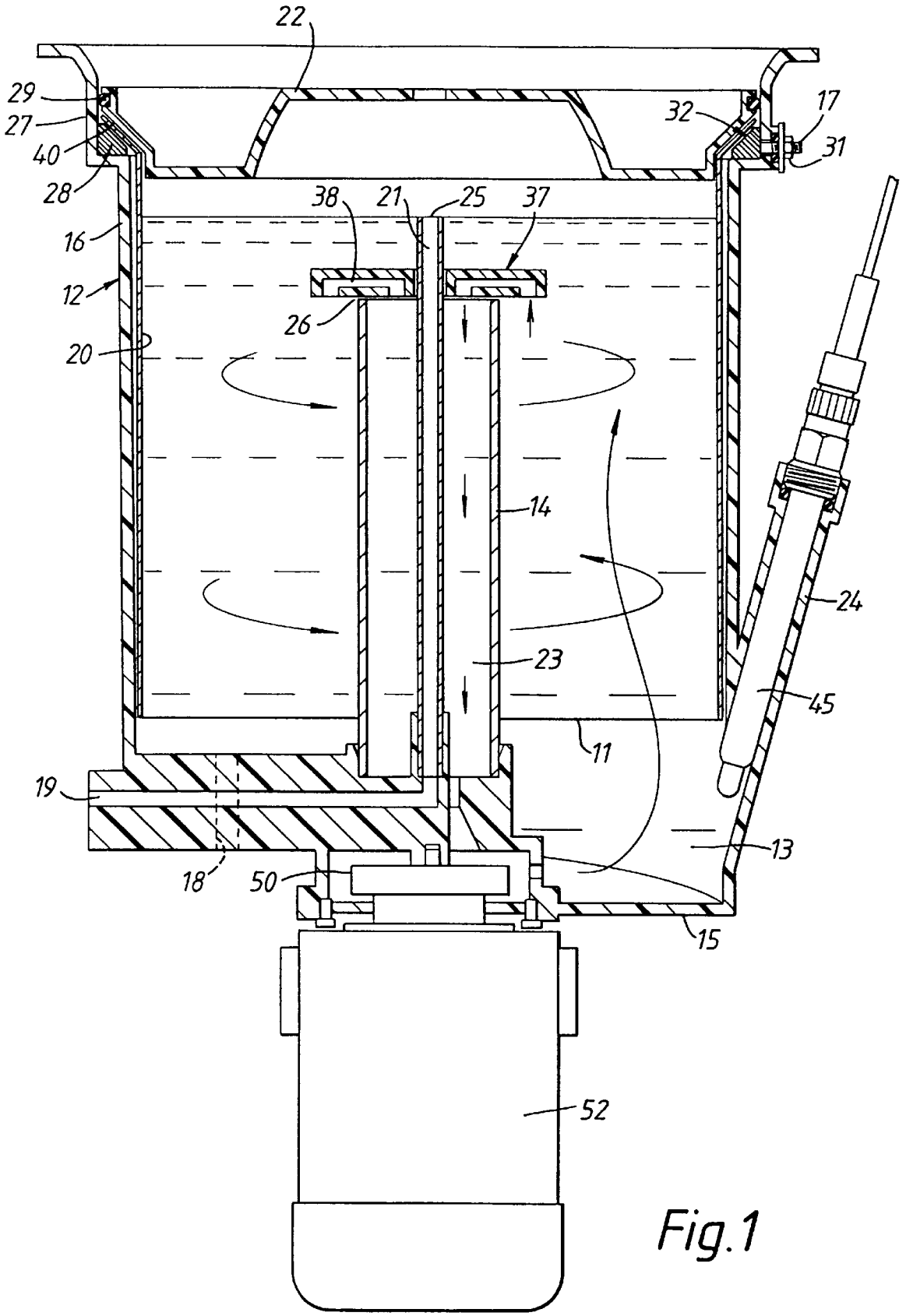
FIG. 1 shows a cross section of an electrolytic cell according to the invention.

As shown in the drawings, an electrolytic cell 10 comprises a cylindrical bucket-shaped housing 12, formed of electrically non- conductive material such as PVC and comprising a base 15 and sides 16. The upper diameter of the housing 10 is marginally larger than the lower diameter by a factor of 1.05. Positioned within the cell are a tubular anode 14 and a cylindrical cathode 20. A liquid inlet opening 18 leads through the base 15 of the cell and opens into the cell between the anode tube 14 and the cathode 20. An outlet opening 19 extends through the base 15 of the cell and leads to a relatively narrow PVC tube defining an outlet passage 21. An annular circulation passage 23 is thereby defined, which surrounds the outlet passage 21 and is concentric therewith. The outlet passage 21 opens from the interior of the cell at a level 25 above the level 26 at which the circulation passage 23 opens into the cell, thereby to define a liquid level in the cell. An annular PVC cap 37 sits on top of the anode tube 14 and includes a U-shaped cross-section channel 38 opening downwards at one end into the circulation passage 23 and at the other end into the interior of the cell. The cathode 20, formed for example of stainless steel covered with a thin layer of silver, is located in the cell 10 with its faces spaced from the sides 16. The lower edge 11 of the cathode is spaced above the base of the housing so as to leave a sump 13 from which a side arm 24 of the housing leads.

The anode 14, in the form of a platinised titanium tube, is secured to the base 15 of the cell by means of a contact piece (not shown in detail) integral with the housing of the cell, which contact piece acts as an electrical connector for the anode. The anode tube 14 lies along the axis of the housing 10. A centrifugal circulation pump 50, together with an associated pump motor 52, is connected to the base of the cell and serves to circulate the liquid in the cell by removing liquid from the circulation passage 23 and injecting it tangentially into the sump 13 of the housing 10, as indicated by the arrows in FIG. 1.

A reference electrode 45 is positioned in the side arm 24 of the housing and protrudes into the sump 13 of the cell. A suitable reference electrode is a pH sensitive glass electrode such as a YOKOGAWA SM21/AG2 or an INGOLD HA265-58/120 glass electrode.

The upper part of the cell is in the form of a neck portion 27 having an opening defined by a stainless steel ring 28, positioned above the liquid level 25. Positioned in the neck of the cell, above the level of the annular ring 28, is a sealing ring 29.

The apparatus further comprises a lid 22 so shaped as to fit into the neck portion 27 of the cell. The lid 22 is formed of electrically non-conductive material such as PVC, and may be formed integrally with the cathode 20.

Figure 2:
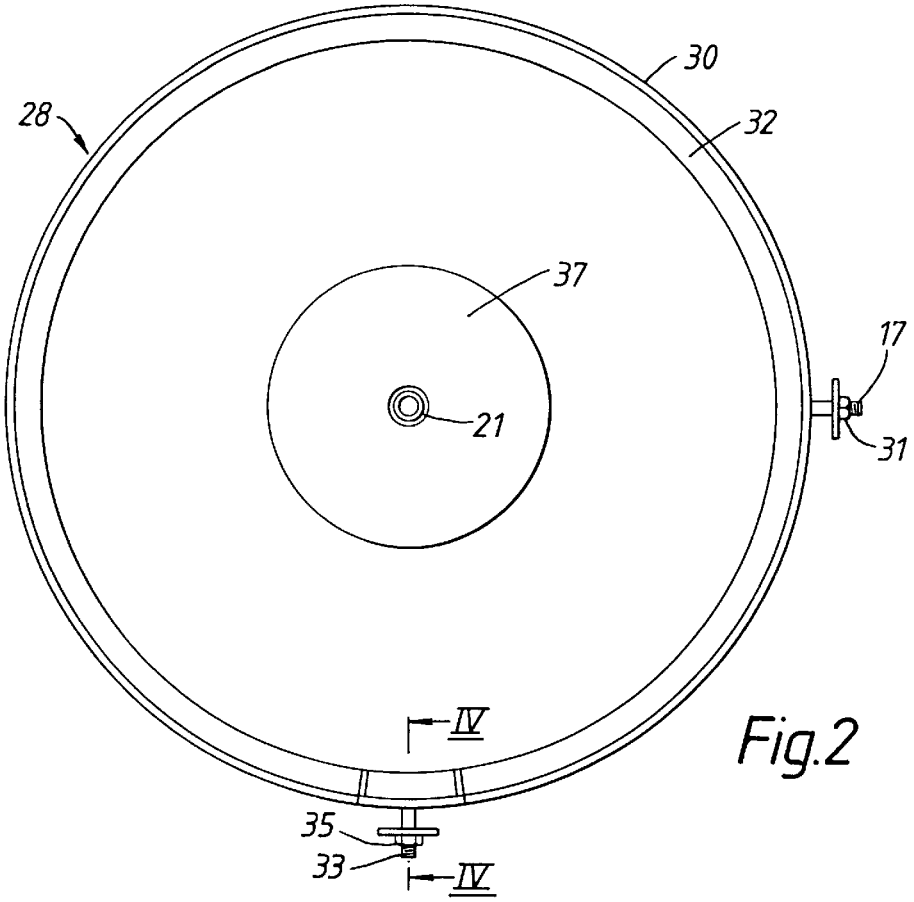
FIG. 2 shows a top view of the electrolytic cell shown in FIG. 1, with the lid and cathode removed.
Figure 3:
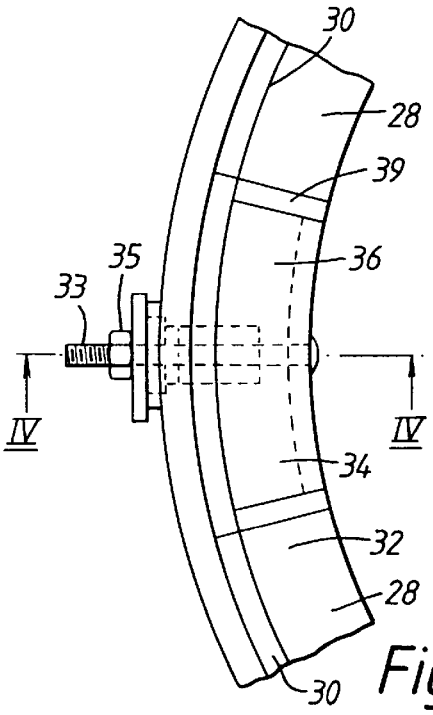
FIG. 3 is an enlargement of part of FIG. 2.

The cathode 20, formed for example of stainless steel sheet having a thickness of 100 $\mu$m, is wrapped around into a cylindrical configuration. The cathode 20 is provided with a deformable upper edge portion, formed by the provision of slots (not shown). The sheet material of which the cathode is formed is sufficiently resilient to allow the upper edge portion to bend outwardly in response to outwardly directed force. As shown in FIGS. 2 and 3, in accordance with the present invention, the ring 28 is modified to include a first portion 30 formed of electrically conductive stainless steel and having a radially inner surface 32 acting as a first contact surface for the cathode 20. A cut-away part of the ring 28 accommodates a second electrically conductive stainless steel portion 34, electrically isolated from the first portion 30 by insulation material 39, the second portion 34 having a radially inner surface 36 acting as a second contact surface 36 for the cathode 20. The contact surface 36 of the second ring portion 34 lies in the same conical plane as the contact surface 32 of the first ring portion 30. The first portion 30 of the ring 28 is permanently fixed to one end of a connecting bolt 17 which extends through the wall of the cell and carries a connecting nut 31 and acts as a power line connector for the cathode 20. The second portion 34 of the ring 28 is permanently fixed to one end of a connecting bolt 33 which extends through the wall of the cell and carries a connecting nut 35 and acts as a sensing line connector for the cathode 20. An insulating bush 71 separates the connecting bolt 33 from the surrounding portion of the ring 28.

As the lid 22 is secured into place, an abutment surface 40 on the lid bears against the upper edge portion of the cathode 20, causing the upper edge portions to bend outwardly to be clamped firmly by the lid against the contact surfaces 32 and 36 of the ring 28, thereby establishing electrical contact there-between.

In the closed position of the lid, the sealing ring 29, which is carried on the lid 22, bears against the neck portion 27 of the cell, thereby forming a tight seal.

Figure 4:
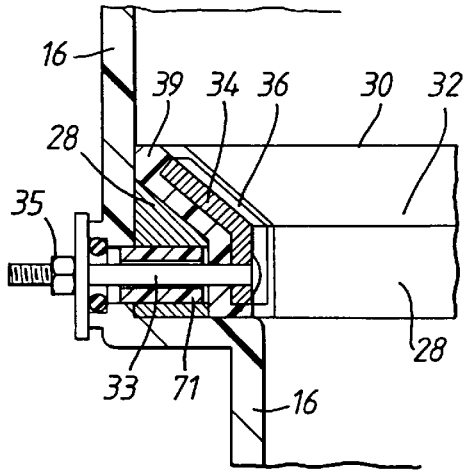
FIG. 4 is a cross-section taken on the line IV—IV in FIGS. 2 and 3.
Figure 5:
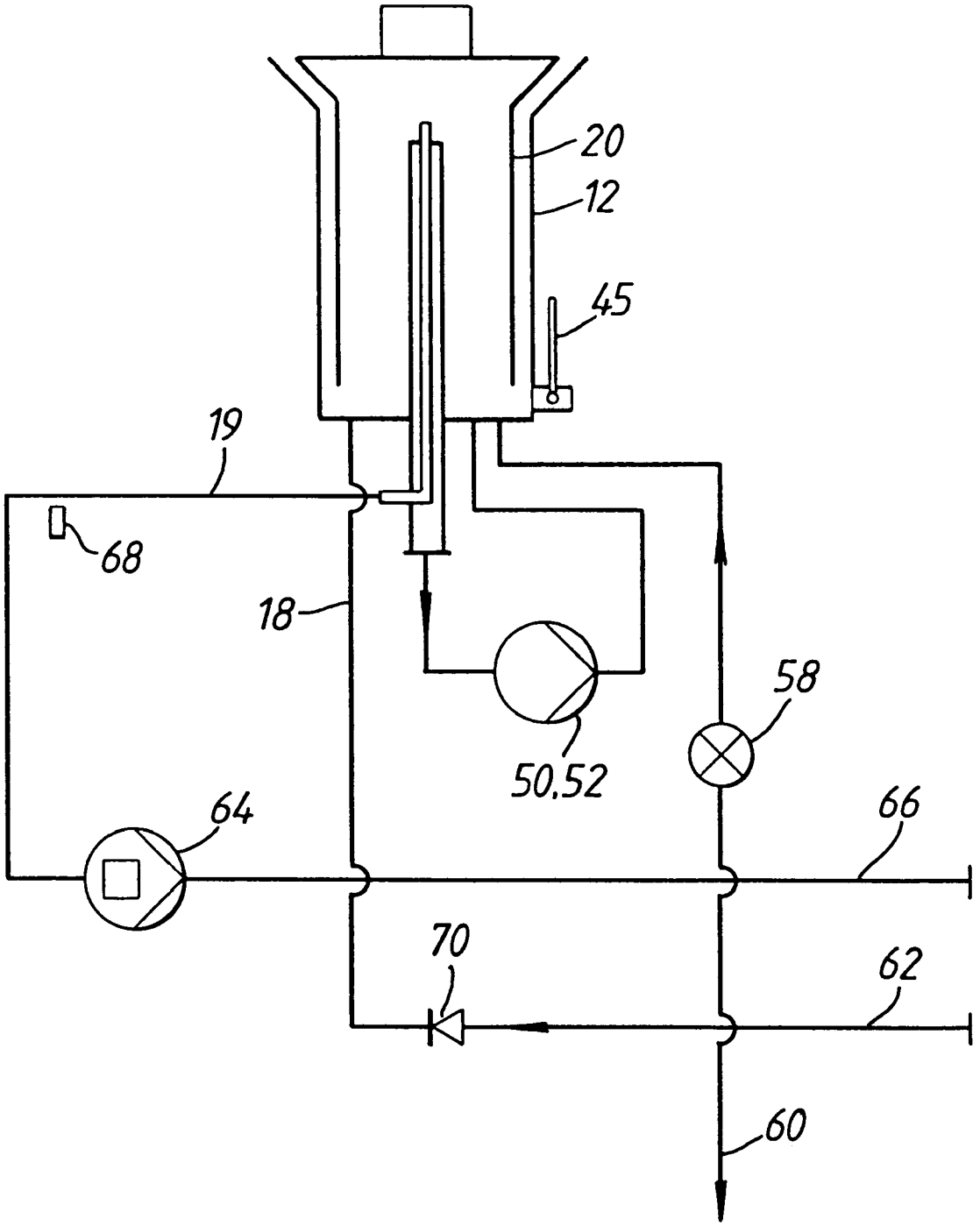
FIG. 5 shows schematically the liquid connections to the cell.

The liquid and electrical connections to the cell are shown schematically in FIGS. 4 and 5.

Fixer or other silver-containing liquid enters along an inlet line 62. When the cell is initially empty, but the lid 22 is attached hermetically sealing the cell, operation of a volumetric pump 64 extracts air from the cell and pulls liquid from the inlet line 62 into the cell through the inlet opening 18. Treated liquid from the cell is pumped by the pump 64 along an exit line 66. An optical level sensor 68 is provided in a cavity adjacent the exit line 66 at a position above the level of the volumetric pump 64. This sensor stops the circulation pump 50 each time too much air passes through the cavity. The volumetric pump 64 continues to operate however. By this arrangement de-aeration of the cell proceeds quickly. Due to the action of the circulation pump 50 a vortex is formed above the outlet passage 21. The air of the vortex is sucked in by the volumetric pump 64. This air is sensed by the sensor 68 which causes the circulation pump 50 to stop. The vortex remains for about one second, allowing even more air to leave the cell.

Once the sensor 68 detects liquid, the circulation pump 50 is caused to re-start. Further pumping not only continues to fill the cell, but also de-aerates the liquid in the cell and establishes a negative pressure within the cell. Such a negative pressure forces the lid 22 further into the cell, thereby improving the contact between the cathode 20 and the contact ring 28. After 2 to 4 deaeration cycles, in a span of less than a minute, only a small air bubble is left above the outlet passage 21. This bubble is too small to create a vortex and no further air enters the outlet passage 21.

An anti-siphoning valve 70 positioned in the inlet line 62, prevents the establishment of a positive pressure in the cell 10, when the cell is situated underneath a processor.

Figure 6:
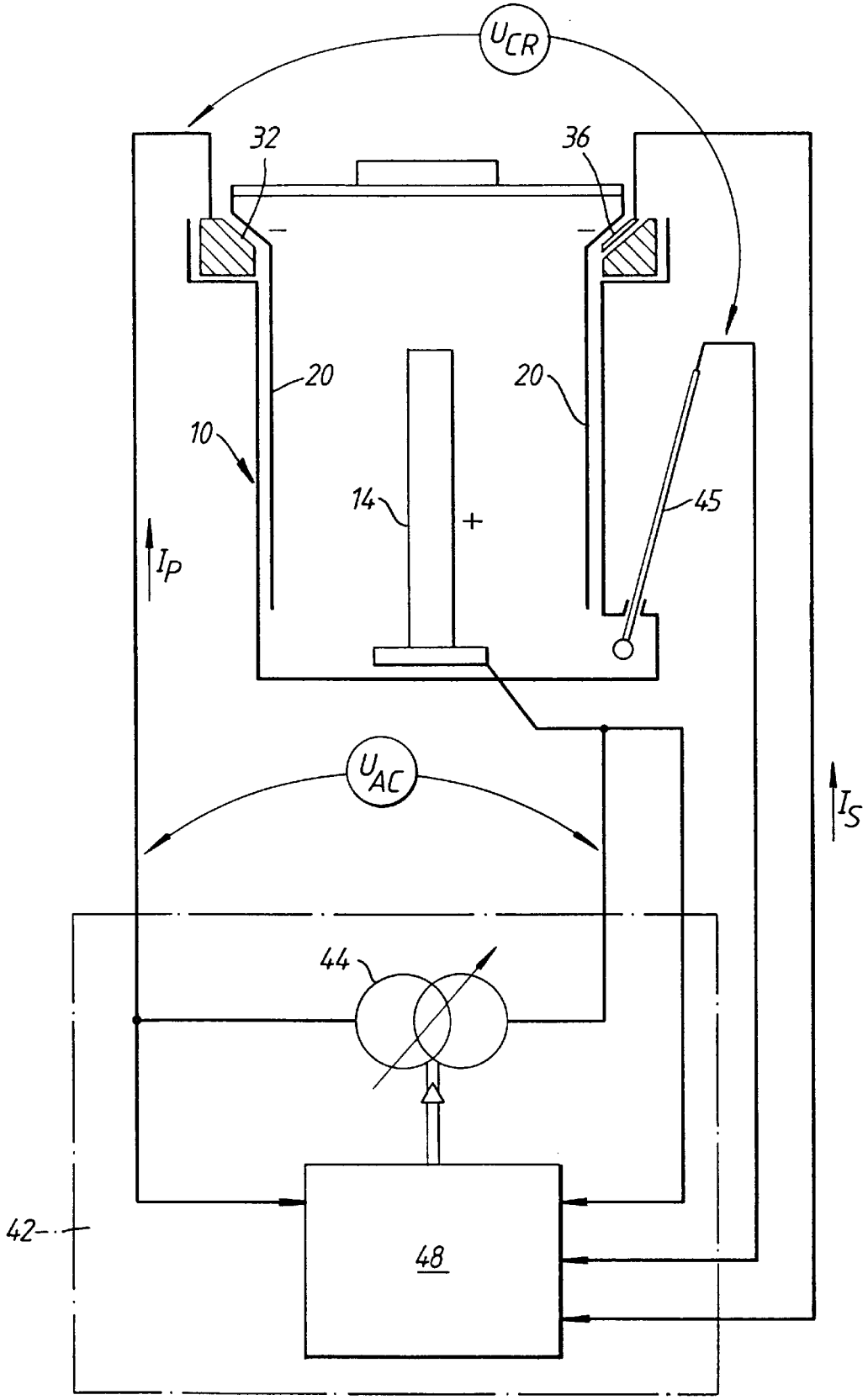
FIG. 6 shows schematically the electrical connections to the cell.

As shown in FIG. 6, the cell 10 is associated with an electronic circuit 42 including a power source 44, for applying electrical power to the cell 10, and a control circuit 48.

The voltage $U_{AC}$ between the first contact surface 32 and the anode 14, and the voltage $U_{CR}$ between the first contact 32 and the reference electrode 45, are fed back to the control circuit 48.

The control circuit 48, in known manner, controls the power source 44 to deliver the necessary electrolysing current $I_P$ which is a function of the electrolysing potential $U_{AC}$, the reference potential $U_{CR}$, time and such other factors as the desired control regime may include. Due to the high current in the circuit from the power source 44 to the cell 10, the voltage drop across the contact surface 32 and the cathode 20 will not be negligable, so that the measured voltage $U_{AC}$ between the first contact surface 32 and the anode 14 is not the exact potential between the cathode 20 and the anode 14.

This problem is solved by using the second contact surface 36 for the cathode. The potential between the second contact surface 36 and the anode 14 is coupled to the control circuit 48. The circuit from the power source 44 to the second contact has a resistance higher than that of the circuit from the power source 44 to the first contact surface 32. As a consequence, the current flowing from the control circuit 48 to the second contact surface 36 is at least one order of magnitude lower than the current $I_p$ flowing from the power source 44 to the first contact 32.

As a result, there is substantially no voltage drop between the second contact surafe 36 and the cathode 20. The potential $U_2$ sensed at the contact surface 36 is therefore closely identical to the potential of the cathode 20. The control circuit 48 responds to any difference between $U_2$ and $U_P$ to ensure that the potential between the cathode 20 and the anode 14 is as required by the control regime.

The potential $U_2$ sensed by the voltage sensor 54 also acts as an idication of the presence of the cathode in the cell.

As the cell is then operated, a silver deposit builds up on the cathode 20, primarily on the inside surface thereof. After a period of time determined by the required amount of deposited silver, the operator releases the lid 22 and lifts the cathode 20 out of the cell. Due to the frusto-conical cross-section of the housing 10, the sides of the cathode will not foul against the ring 28, even when some small amount of silver deposit has built up on the outside surface thereof. The silver deposit is then removed from the cathode, which may then be re-used as desired or replaced by another cathode of similar construction for the de-silvering of a further batch of electrolyte. The cell may be drained via a drain valve 58 and drain line 60.

Reference Number List

| | |
|---|---|
| electrolytic cell 10 | second contact surface 36 |
| lower edge 11 | cap 37 |
| housing 12 | channel 38 |
| sump 13 | insulation material 39 |
| anode 14 | abutment surface 40 |
| base 15 | electronic circuit 42 |
| sides 16 | power source 44 |
| connecting bolt 17 | reference electrode 45 |
| inlet opening 18 | control circuit 48 |
| outlet opening 19 | circulation pump 50 |
| cathode 20 | pump motor 52 |
| outlet 21 | control line 57 |
| lid 22 | drain valve 58 |
| circulation passage 23 | drain line 60 |
| side arm 24 | inlet line 62 |
| liquid level 25 | volumetric pump 64 |
| level 26 | exit line 66 |
| neck portion 27 | level sensor 68 |
| stainless steel ring 28 | anti-siphoning valve 70 |
| sealing ring 29 | insulating bush 71 |
| first portion 30 | |
| connecting nut 31 | |
| first contact surface 32 | |
| connecting bolt 33 | |
| second portion 34 | |
| connecting nut 35 | |

What is claimed is:

1. An electrolytic cell comprising a housing (12), means (21) defining a liquid level (25) in said housing (12), and a first contact surface (32) positioned above said liquid level (25) for making contact with a removable electrode (20) when positioned in said housing (12), to supply electrolysing electrical power thereto, characterised by a second contact surface (36) positioned above said liquid level (25) and electrically isolated from said first contact surface (32) for making contact with said removable electrode (20) when positioned in said housing (12), to monitor the electrical potential on said electrode (20) during use.

2. An electrolytic cell according to claim 1, further comprising clamping means (22) for clamping said removable electrode (20) against said first and second contact surfaces (32, 36).

3. An electrolytic cell according to claim 2, wherein said first contact surface (32) is constituted by a first electrically conductive portion (30) of an elongate member (28), said second contact surface (36) being constituted by a second electrically conductive portion (34) of said elongate member (28).

4. An electrolytic cell according to claim 3, wherein said elongate member (28) is in the form of a ring.

5. An electrolytic cell according to claim 1, together with an electronic circuit (42) including a power source (44) for applying electrical power at an electrolysing potential ($U_P$) to said first contact surface (32), control means (48) connected to said second contact surface (36) for sensing the potential ($U_2$) at said second contact surface (36) and for controlling said electrolysing potential ($U_P$) in response to the potential ($U_2$) sensed at said second contact.

6. An electrolytic cell according to claim 5, wherein the circuit from said power source (44) to said second contact surface (36) has a resistance higher than that of the circuit from said power source (44) to said first contact surface (32).

7. A method of electrolysis in an electrolytic cell (10) comprising a housing (12) and a removable electrode (20) positioned in said housing (12), the method comprising supplying liquid to be treated to said cell (10) and supplying electrical power to said electrode (20) at an electrolysing potential ($U_P$) via a first contact surface (32) in contact with said electrode (20) and positioned above the level (25) of said liquid, characterised by sensing the potential ($U_2$) at a second contact surface (36) positioned above said level (25) of said liquid, said second contact surface (36) being electrically isolated from said first contact surface (32) and in contact with said removable electrode (20), and controlling said electrolysing potential ($U_P$) in response thereto.

8. A method according to claim 7, wherein said removable electrode is a cathode and said method comprises the electrolytic recovery of silver from a silver-containing solution.

9. A method according to claim 7, wherein electrical power at an electrolysing potential ($U_P$) is applied to said first contact surface (32) from a power source (44), and the current ($I_2$) flowing from said power source (44) to said second contact surface (36) is at least one order of magnitude lower than the current ($I_p$) flowing from said power source (44) to said first contact surface (32).

* * * * *

UNITED STATES PATENT AND TRADEMARK OFFICE

CERTIFICATE OF CORRECTION

PATENT NO. : 6,071,399

DATED : June 6, 2000

INVENTOR(S) : Van den Bergen et al.

It is certified that error appears in the above-identified patent and that said Letters Patent is hereby corrected as shown below:

Title Page, Item [75] Inventors: "Van der Bergen" (both occurrences) should read -- Van den Bergen --; and "Jansen" should read -- Janssen --.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*